United States Patent [19]

Logsdon

[11] Patent Number: 4,742,585

[45] Date of Patent: May 10, 1988

[54] TUB BOX

[76] Inventor: Duane D. Logsdon, 1708 Calavera Dr., Fullerton, Calif. 92631

[21] Appl. No.: 44,748

[22] Filed: May 1, 1987

[51] Int. Cl.[4] ..... A47K 17/00

[52] U.S. Cl. ..... 4/661; 4/206; 220/3.3; 220/3.4; 220/3.9; 52/577

[58] Field of Search ..... 4/206, 661; 52/577; 220/3.3, 3.9, 3.4

[56] References Cited

U.S. PATENT DOCUMENTS

| | | | |
|---|---|---|---|
| 1,438,751 | 12/1922 | Des Isles | 220/3.3 |
| 3,276,176 | 10/1966 | Jonsson et al. | 52/577 X |
| 3,358,866 | 12/1967 | Kinney | 220/3.9 |
| 3,495,276 | 2/1970 | Suess | 220/3.3 |
| 3,593,344 | 7/1971 | Logsdon | 4/206 |
| 3,708,929 | 1/1973 | Estes et al. | 52/577 X |
| 3,877,601 | 4/1975 | Evans et al. | 220/3.3 |

*Primary Examiner*—Henry K. Artis

[57] ABSTRACT

An improved tub box structure can be manufactured so as to utilize a container shaped so as to include a bottom wall and a top peripheral wall extending upwardly from the bottom wall, this peripheral wall sloping between its top and its bottom so as to diverge upwardly from the bottom wall. Knock out openings are provided in the bottom wall and in the peripheral wall for use in passing a pipe into the tub box structure. A lid capable of closing off the interior of the container is fitted into the top of the container so that it may be easily removed.

5 Claims, 2 Drawing Sheets

TUB BOX

BACKGROUND OF THE INVENTION

The invention set forth in this specification pertains to a new and improved tub box structure.

More specifically the present invention relates to a tub box which is considered to be an improvement over a prior tub box or tub box structure as set forth in the U.S. Pat. No. 3,593,344 issued July 20, 1971 entitled "Tub Box Structure." A tub box structure as set forth in this prior patent utilizes two tub shaped containers assembled together in a face to face relationship. The lower of these two containers is constructed so as to include an opening adapted to receive a pipe and perforate ears adapted to be utilized in supporting the complete tub box structure. As the tub box structure is used stakes such as lengths of concrete reinforcing rod are secured to the ears so as to hold the tub box structure in a desired location until such time as the area immediately adjacent to the lower or bottom container is filled in and until a slab is poured relative to the complete tub box structure.

Normally the ground will be filled in around the tub box prior to the slab being poured to such an extent that the slab will only extend around a portion of the upper container. It is normally intended to utilize this prior tub box structure as shown in the prior patent so that after the slab is poured and has set up a portion of the uppermost container can be exposed so that it will be severed from the remainder of the structure in order to provide access into the interior of the tub box structure so that plumbing can be connected in a normal manner.

Although tub box structures as indicated in the preceding are undoubtedly desirable and utilitarian it is considered that several aspects of them are somewhat undesirable and/or disadvantageous. Because of the manner in which these prior tub box structures are constructed there is always at least a degree of danger that the two tub like containers may be displaced from one another to a limited extent as such a prior tub box structure is being installed. As a consequence of this there is always a danger that the interior of the tub box or tub box structure will become contaminated with ambient materials and/or concrete. Further, it is not always reasonably possible to locate a pipe entering a structure through a peripheral or side wall as illustrated in the prior U.S. patent. In addition it frequently is somewhat disadvantageous to have to find a tool to sever a part of the top or upper container in such a prior tub box structure after a concrete slab has been poured around the complete tub box structure and has been allowed to set up.

BRIEF SUMMARY OF THE INVENTION

As a result of these factors it is considered that there is a need for new and improved tub box structures. The present invention is intended to provide such new and improved tub box structures. It is intended to provide tub boxes or tub box structures which are constructed in such a manner that there is virtually no danger of contaminants entering such tub boxes or tub box structures as they are installed in place, which are constructed in such a manner that they can be installed so as to accommodate pipes so that such pipes enter these structures in a variety of different manners and which are constructed so that it is not necessary to cut off or sever a part of a container in order to gain access to the interiors of these structures.

The invention is also intended to provide tub boxes or tub box structures which may be easily and conveniently manufactured at a comparatively nominal cost. It is further intended to provide tub boxes or tub box structures which are of such a character that there is little if any danger of them becoming collapsed as they are installed and used even though they are constructed so as to minimize the amount of material employed in them. These latter two factors of the invention are considered to be significantly important both from a practical and a utilitarian standpoint.

In accordance with this invention these various objectives are achieved by providing a tub box structure which includes: a container having a bottom wall and a top peripheral wall extending upwardly from said bottom wall, said peripheral wall including front and a back side walls and parallel end walls and corner walls located at an angle to said front, back and end wall and connecting said front, back, and end walls, said bottom wall and said peripheral wall including a plurality of knockout openings formed therein which are adapted to be used so as to allow a pipe to enter the interior of said container, said container being larger adjacent to its top than at its bottom and continuously changing in its dimension from its bottom to its top, said container including perforate ears for use in supporting said container in a desired location such that said top is horizontal and lid means for closing the top of said container, said container and said lid means being formed of a self supporting polymer material which is inert with respect to soil and concrete.

BRIEF DESCRIPTION OF THE DRAWINGS

The invention is best more fully explained with reference to the accompanying drawings in which.

Figure 1:
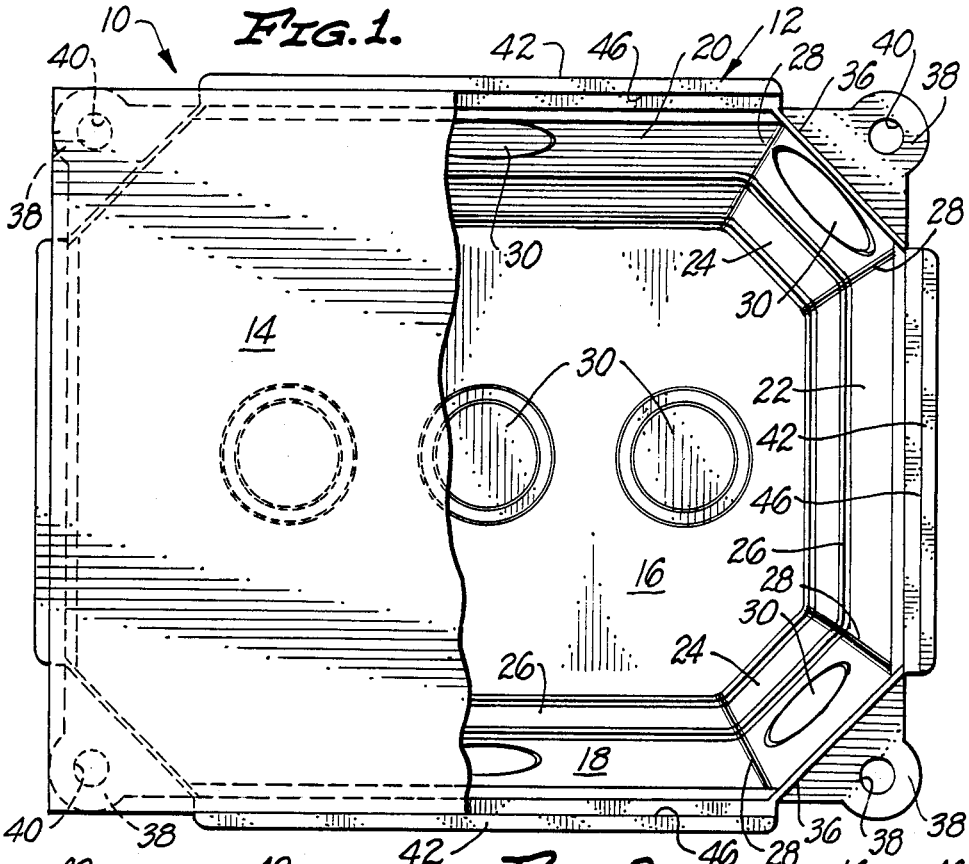
FIG. 1 is a top plan view of a presently preferred tub box or tub box structure in accordance with this structure, the lid of this tub box being partially broken away so as to expose the interior of the container of the tub box.
Figure 2:
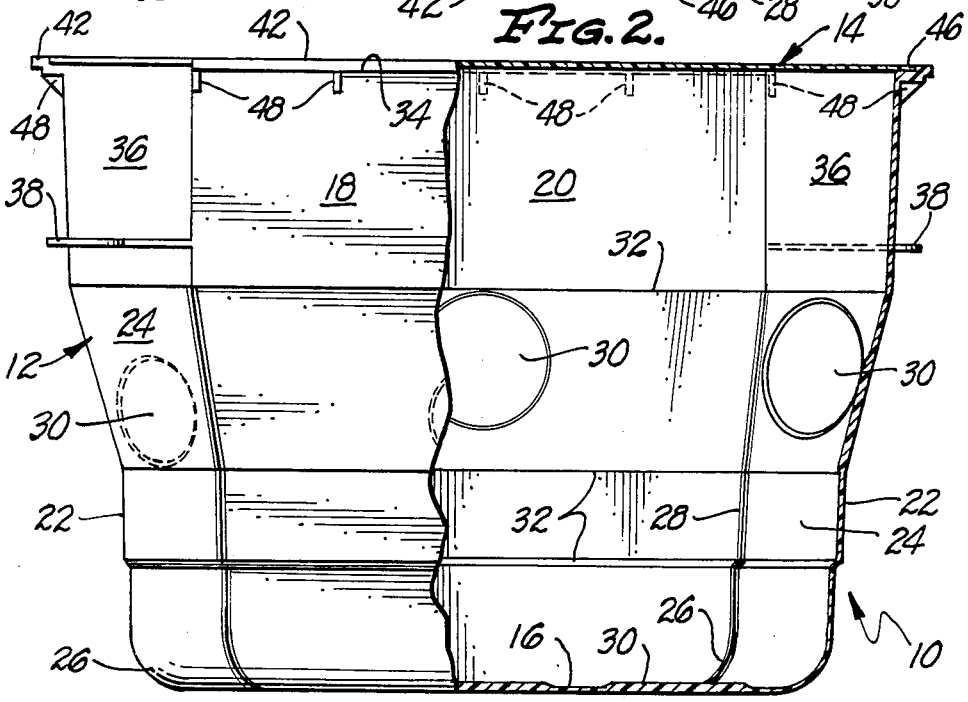
FIG. 2 is a side elevational view of the tub box shown in FIG. 1, a part of a peripheral wall of this container being broken away so as to clearly indicate its internal structure.
Figure 3:
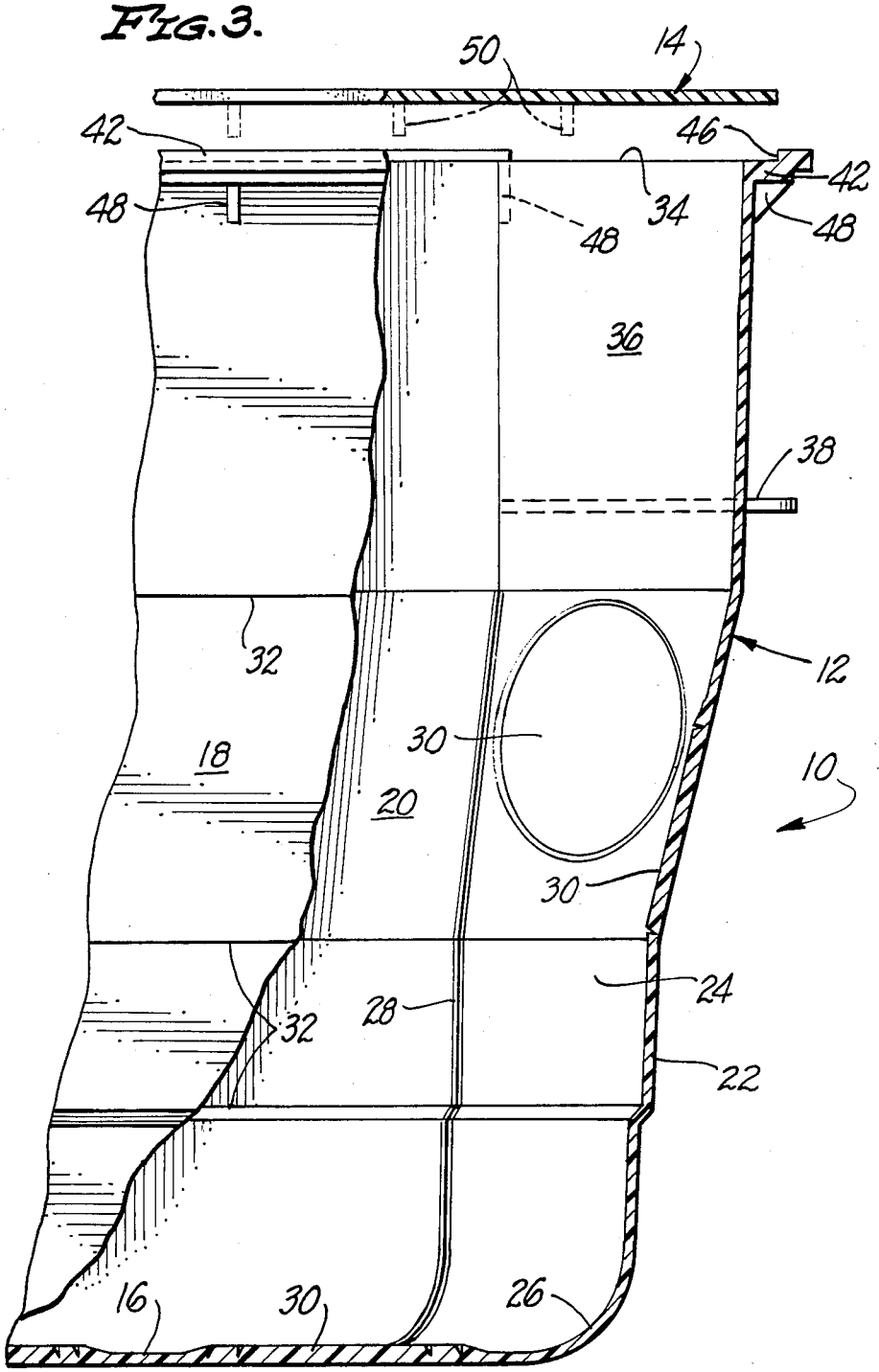
FIG. 3 is a partial view similar to FIG. 2 at an enlarged scale indicating various details of the tub box shown in the preceding figures.

The precise tub box illustrated is constructed so as to utilize the operative concepts or principles set forth and defined in the appended claims forming a part of this disclosure. Those in the field of the design and construction of tub boxes and related items in the plumbing field will realize that the concepts or principles of the present invention as set forth in the appended claims can be embodied within a variety of somewhat differently appearing or differently constructed tub boxes through the use or exercise of routine skill in the noted field. For this reason the invention is not to be construed as being limited by the accompanying drawing but instead is to be considered as being limited by the appended claims.

DETAILED DESCRIPTION OF THE PREFERRED EMBODIMENT

In the accompanying drawing there is shown a tub box or tub box structure 10 in accordance with the present invention which is constructed so as to include two parts: (1) a container 12; and (2) a lid 14 which is adapted to close off the interior of the container 12. Both of these parts—i.e. the container 12 and the lid 14—are designed so that they can be easily and conveniently manufactured at a comparatively nominal cost out of a self supporting, inert, reasonably rigid polymer material. Since a number of such materials are well known it is not consider necessary or desirable to encumber this specification with a list of them. It is considered important to note that the container 12 and the lid 14 are designed so as to simplify the dies used in constructing these parts to as great a degree as considered reasonably possible. This is desired in order to effect economy of manufacture.

The container 12 has a generally flat bottom wall 16 which is attached to front and rear walls 18 and 20 respectively, end walls 22 and diagonal corner walls 24. Collectively these walls 18, 20, 22, and 24 may be considered to constitute a peripheral wall (not numbered) It is noted that the junctures 26 of the bottom wall 16 with these various walls 18, 20, 22 and 24 are curved so as to avoid the presence of comparatively sharp corners which might be considered as stress points. Similarly the junctures 28 between the corner walls 24 and the other walls 18, 20 and 22 are slightly curved for the same reason. Preferably a series of conventional knock out openings 30 are located in the bottom wall 16 and in the walls 18, 20, 22 and 24 so as to permit a pipe to enter the container 12 in a known manner from whatever direction is most convenient or most desirable.

It is noted that the walls 18, 20, 22 and 24 are provided with continuous peripheral bends 32 extending parallel to the bottom wall 16 which are considered to slightly aid in minimizing the bending of these walls. Other equivalent expedients can also be used. Also it is noted that the walls 18, 20, 22 and 24 all diverge outwardly from the bottom wall 16 so that the bottom wall 16 is smaller than the top edge 34 of the container 12. This is considered to facilitate the construction of the dies to mold the container 12 and to contribute to the container 12 in being comparatively easy and inexpensive to mold.

Preferably the corner walls 24 are provided with small upper walls or wall sections 36 which extend parallel to one another so as to make it possible to easily mold extended perforate ears or projections 38 on the corner walls 24. The presence of small vertical walls such as the wall section 36 does not significantly complicate the molding of the container 12 and makes it possible to mold the ears 38 without the dies used in molding the container 12 having any undercuts.

These ears 38 extend horizontally and are provided with small holes 40 which are adapted to be utilized in attaching the tub box 10 to supporting stakes as indicated in the prior U.S. Pat. No. 3,593,344. So as to avoid any question as to the sufficiency of the specification relative to the mounting of the tub box 10 the entire disclosure of this prior patent is included herein by reference. Preferably these ears 38 can be bent or deformed slightly as the tub box 10 is used so as to facilitate the installation of the tub box 10 in its desired location.

This tub box 10 also includes peripheral lips 42 located at the top 44 of the container 12 which extend from the walls 18, 20, 22, and 24 along the lengths of these walls. Each of the lips 42 is provided with an inwardly facing notch 46 so that the lid 14 may be located as shown in the drawing. This lid 14 is shaped so as to conform to the interiors of the notches 46 and so as to fit along the entire top 44 without projecting past the upper sections 36. This results in the ears 38 being exposed to as great a degree as reasonably possible to facilitate the location of the tub box 10 in a desired location for use.

If desired small reinforcing webs 48 may be located under the lips 42 for the purpose of holding them so that they are not apt to be bent or otherwise damaged. If desired conventional means (not shown) such as a handle may be located on the lid 14 so as to facilitate the lid being located and removed after the tub box 10 has been installed and used. If desired stiffening ribs 50, as shown in phantom, may be located on the lid 14 so as to fit generally within the container 12 in order to prevent the lid 14 from bending as the tub box 10 is being installed.

Normally this tub box will be used in such a manner that the lid 14 is at or slightly below the surface of a concrete slab (not shown) poured in placing relationship to the box 10. As a consequence of this the lid 14 can always be conveniently engaged or manipulated through the use of a tool such as a screw driver (not shown) so as to open up the complete box 10 so that it may be utilized in its intended manner in connection with a plumbing operation.

I claim:

1. A tub box structure which includes:

a container having a bottom wall and a top peripheral wall extending upwardly from said bottom wall, lid means for closing the top of said container, said peripheral wall including front, back and end walls and corner walls each of which is located at an angle to said front, back and end walls and connecting said front, back and end walls, said bottom wall and said peripheral wall including a plurality of knockout openings formed therein which are adapted to be used so as to allow a pipe to enter the interior of said container, said container being larger adjacent to its top than at its bottom and continuously changing in its dimension from its bottom to its top, the top of said container is larger than said bottom wall so that said front and rear walls, said end walls and said corner walls all diverge outwardly from said bottom wall, said container including perforate ears located on said peripheral wall for use in supporting said container in a desired location such that said top is horizontal and lid means for closing the top of said container, said front and rear walls, said end walls and said corner walls are provided with continuous peripheral beads extending parallel to said bottom wall serving so as to minimize the bending of said front and rear walls, said ends walls and said corner walls, said container includes peripheral lips at the top of said container extending along the lengths of the front, back and end walls, said lips including notches capable of receiving said lid so as to hold said lid in place against movement relative to said container, said container and said lid means being formed of a self supporting polymer material which is inert with respect to soil and concrete.

2. A tub box structure as claimed in claim 1 wherein:

said ears are capable of being deformed during the installation of said tub box structure.

3. A tub box structure as claimed in claim 1 wherein:

the junctures between said bottom wall and said front and rear walls, said end walls and said corner walls and the junctions between said corner walls and said front and rear walls and said end walls are all curved so as to avoid the presence of stress points.

4. A tub box structure as claimed in claim 1 wherein:

sections of said corner walls extending between said ears and the top of said container are parallel flat walls.

5. A tub box structure as claimed in claim 1 wherein:

said ears are capable of being deformed during the installation of said tub box structure, the junctures between said bottom wall and said front and rear walls, said end walls and said corner walls are curved so as to avoid the presence of stress points, the junctions between said corner walls and said front and rear walls and said end walls are curved so as to avoid the presence of stress points, sections of said corner walls extending between said ears and the top of said container are parallel flat walls.

* * * * *